US011779830B2

(12) United States Patent
Staffaroni

(10) Patent No.: US 11,779,830 B2
(45) Date of Patent: Oct. 10, 2023

(54) MICRO BOARD

(71) Applicant: Michael G. Staffaroni, Dallas, TX (US)

(72) Inventor: Michael G. Staffaroni, Dallas, TX (US)

( * ) Notice: Subject to any disclaimer, the term of this patent is extended or adjusted under 35 U.S.C. 154(b) by 0 days.

(21) Appl. No.: 17/724,751

(22) Filed: Apr. 20, 2022

(65) Prior Publication Data

US 2022/0355186 A1 Nov. 10, 2022

Related U.S. Application Data

(60) Provisional application No. 63/177,444, filed on Apr. 21, 2021.

(51) Int. Cl.

| | |
|---|---|
| ***A63C 17/01*** | (2006.01) |
| ***A63C 17/06*** | (2006.01) |
| ***A63C 17/14*** | (2006.01) |
| ***A63C 17/26*** | (2006.01) |

(52) U.S. Cl.

CPC ..... *A63C 17/016* (2013.01); *A63C 17/015* (2013.01); *A63C 17/06* (2013.01); *A63C 17/1436* (2013.01); *A63C 17/262* (2013.01); *A63C 2203/08* (2013.01); *A63C 2203/10* (2013.01)

(58) Field of Classification Search

CPC ... A63C 2203/10; A63C 17/01; A63C 17/015; A63C 17/26; A63C 2203/42

See application file for complete search history.

(56) References Cited

U.S. PATENT DOCUMENTS

| | | | | |
|---|---|---|---|---|
| D493,858 | S * | 8/2004 | Green | D21/763 |
| 6,981,711 | B2 * | 1/2006 | Seta | A63C 17/04 280/87.041 |
| 7,201,387 | B2 * | 4/2007 | Seta | A63C 17/014 280/87.05 |
| 7,976,034 | B1 * | 7/2011 | Hong | A63C 17/01 280/87.042 |
| 8,573,614 | B2 * | 11/2013 | Duarte | A63C 17/01 280/11.208 |
| 8,910,959 | B2 * | 12/2014 | Alva | A63C 17/015 280/87.05 |
| 9,095,766 | B1 * | 8/2015 | Christie | A63C 17/01 |
| 9,504,901 | B1 * | 11/2016 | Lu | B62K 15/006 |
| 9,844,719 | B1 * | 12/2017 | Huang | A63C 17/12 |
| 10,071,302 | B2 * | 9/2018 | Sala | A63C 17/015 |
| 10,092,818 | B2 * | 10/2018 | De Minicis | A63C 17/12 |

(Continued)

FOREIGN PATENT DOCUMENTS

| | | | | |
|---|---|---|---|---|
| EP | 0834337 | A2 * | 9/1997 | |
| EP | 1070521 | A1 * | 1/2001 | A63C 17/0086 |

*Primary Examiner* — Emma K Frick

(57) ABSTRACT

In a preferred embodiment a wheeled platform apparatus and method for use in rolling on a surface are provided. The apparatus includes a platform having a top surface, a bottom surface, a front portion, a center portion, a rear portion, and a first wheel and a second wheel that interface with or are positioned below the bottom surface of the platform to facilitate rolling movement of the platform. The apparatus may further include an attachment device interfacing with the top surface and the footwear, as well as a footrest to support the forefoot of another foot, or footwear.

5 Claims, 24 Drawing Sheets

(56) References Cited

U.S. PATENT DOCUMENTS

| | | | | |
|---|---|---|---|---|
| 2003/0214109 | A1* | 11/2003 | Hedeen, Jr. | A63C 17/262<br>280/87.042 |
| 2004/0021282 | A1* | 2/2004 | Grattini | A63C 17/26<br>280/11.19 |
| 2016/0114242 | A1* | 4/2016 | Riley | A63C 17/12<br>180/233 |
| 2021/0322859 | A1* | 10/2021 | Zhang | A63C 17/12 |

* cited by examiner

FIG. 6
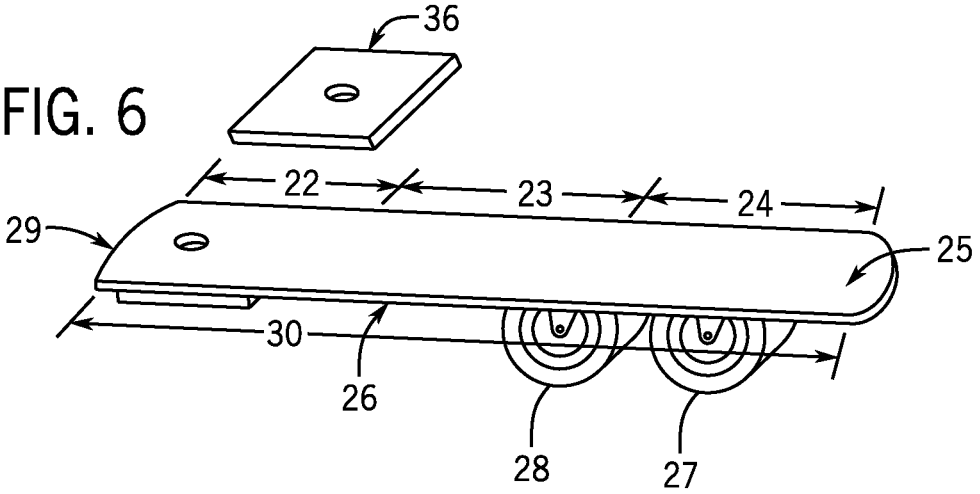
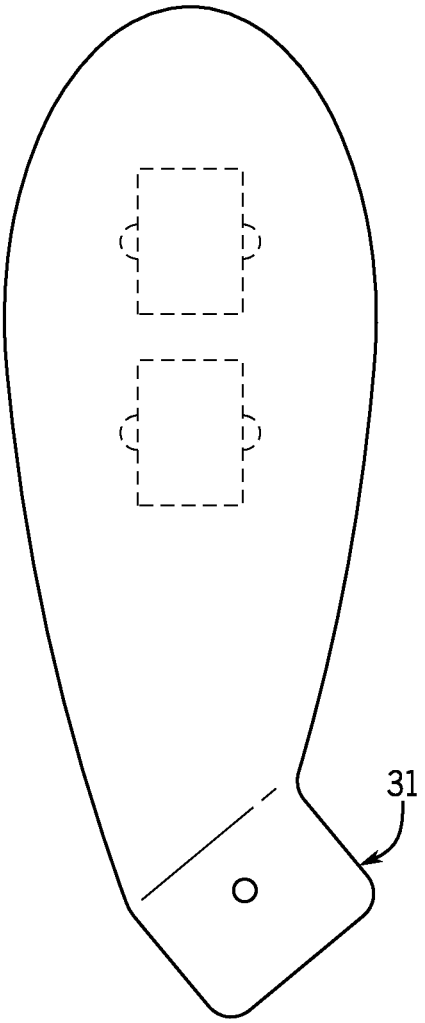
FIG. 7A
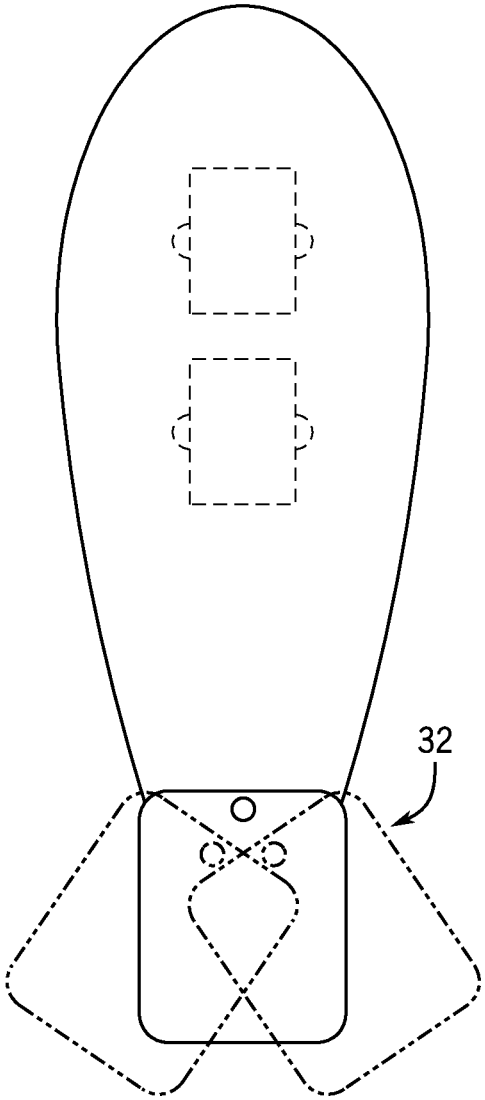
FIG. 7B

MICRO BOARD

RELATED APPLICATION

This application claims priority to U.S. Provisional Application No. 63/177,444 filed Apr. 21, 2021, which is incorporated herein in its entirety.

FIELD

This invention relates in general to the field of active sports and more particularly to a wheeled platform.

BACKGROUND

Active sports often include skateboards, scooters and wheeled apparatuses. Some individuals, however, desire more functionality and versatility than provided by conventional skateboards, scooters and wheeled apparatuses.

SUMMARY

A wheeled platform apparatus is provided that includes a top surface, a bottom surface, at least two wheels extending at least partially through or attached to the bottom surface. The total surface of the platform is minimized for convenient storage and transport when not in use.

Other technical advantages are readily apparent to one skilled in the art from the following figures and description.

BRIEF DESCRIPTION

For a more complete understanding of the present invention, reference is now made to the following brief description, taken in connection with the accompanying drawings and detailed description, wherein like reference numerals represent like parts, in which:

FIG. 1B is a breakaway and perspective view that illustrates a two-piece wheel that includes an inner core and an outer tire, bearings, axle and clasp that may be used in the present invention;

FIG. 6 is a perspective view that illustrates one embodiment of a wheeled platform apparatus with a top surface also referred to as an upper surface, a bottom surface, a footrest which is also referred to as a back portion, at least two wheels that may include a replaceable brake pad;

FIG. 7A, 7B are top views that illustrate one embodiment of a wheeled platform apparatus with a footrest that is an adjustable footrest which can be moved to at least three different positions to maximize comfort and ease of operation for the user;

Figure 21:
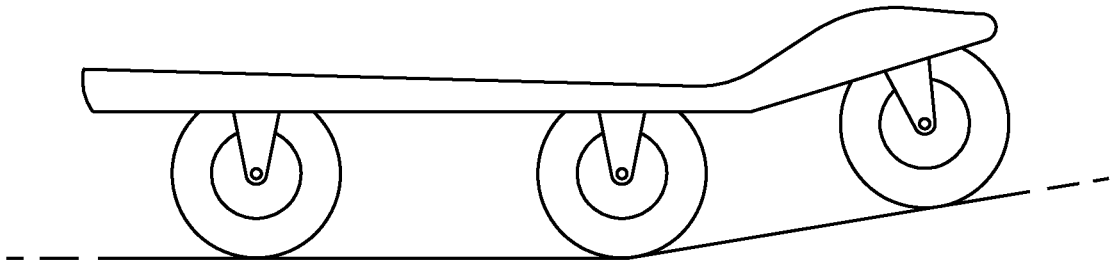

FIG. 21 illustrates a configuration in which the front portion of the skating platform is parallel with the skating surface but includes a rear portion extending up at an angle away from the skating surface. The extended portion includes at least one wheel rotatably mounted allowing the user to shift weight from the front portion of the platform to the rear portion thus raising the front most wheel off the skating surface and engaging the wheel(s) on the rear portion extension and the rear most wheel of the front portion simultaneously. The user is then able to ride in this "wheelie" position for a short distance before returning to a natural skating position in which the rear extension wheel is no longer engaged with the skating surface.

Figure 22A:
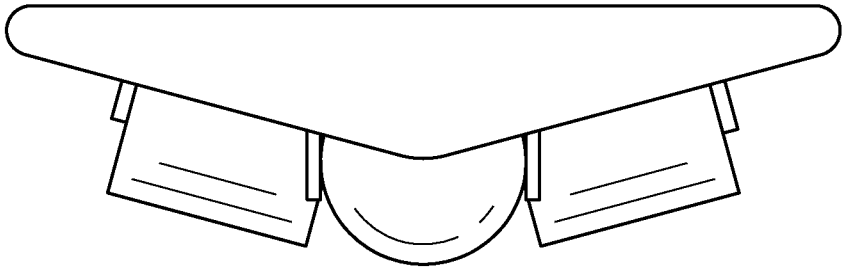
Figure 22B:
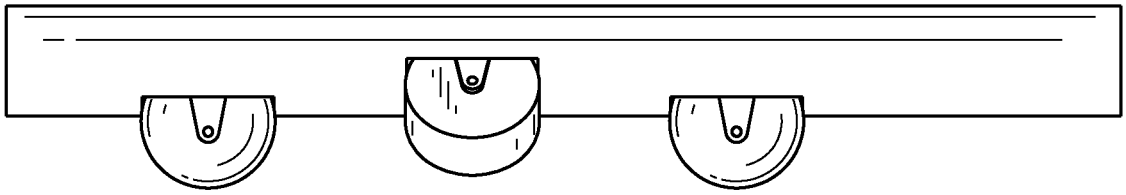
Figure 22C:
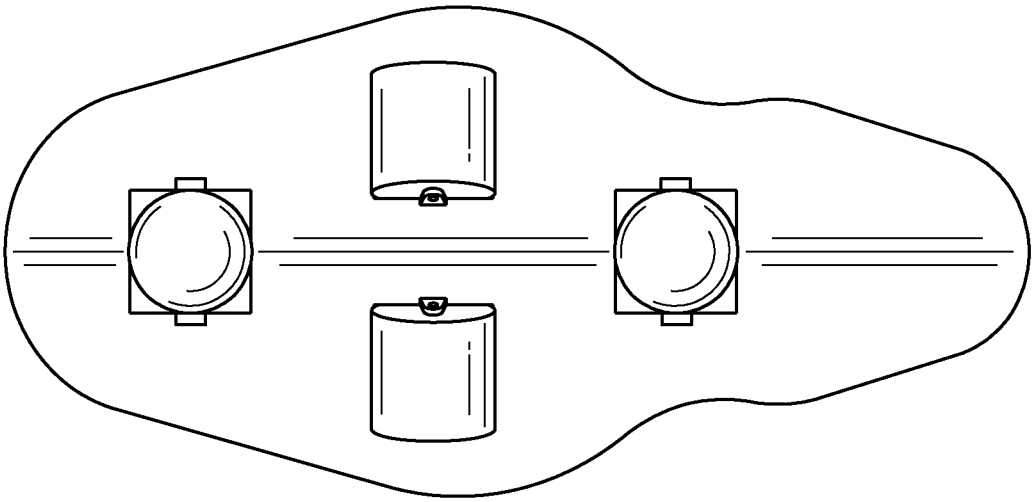

FIG. 22A, 22B, 22C illustrate a configuration in which there are at least two center wheels. In addition, the configuration has at least one lateral wheel on each side of the center wheels. The lateral wheels are angled upward toward the outer edge of the apparatus. This allows the apparatus to function using the center wheels only or shift weight to either side to engage the lateral wheel(s) thus improving maneuverability and turning ability.

Figure 23A:
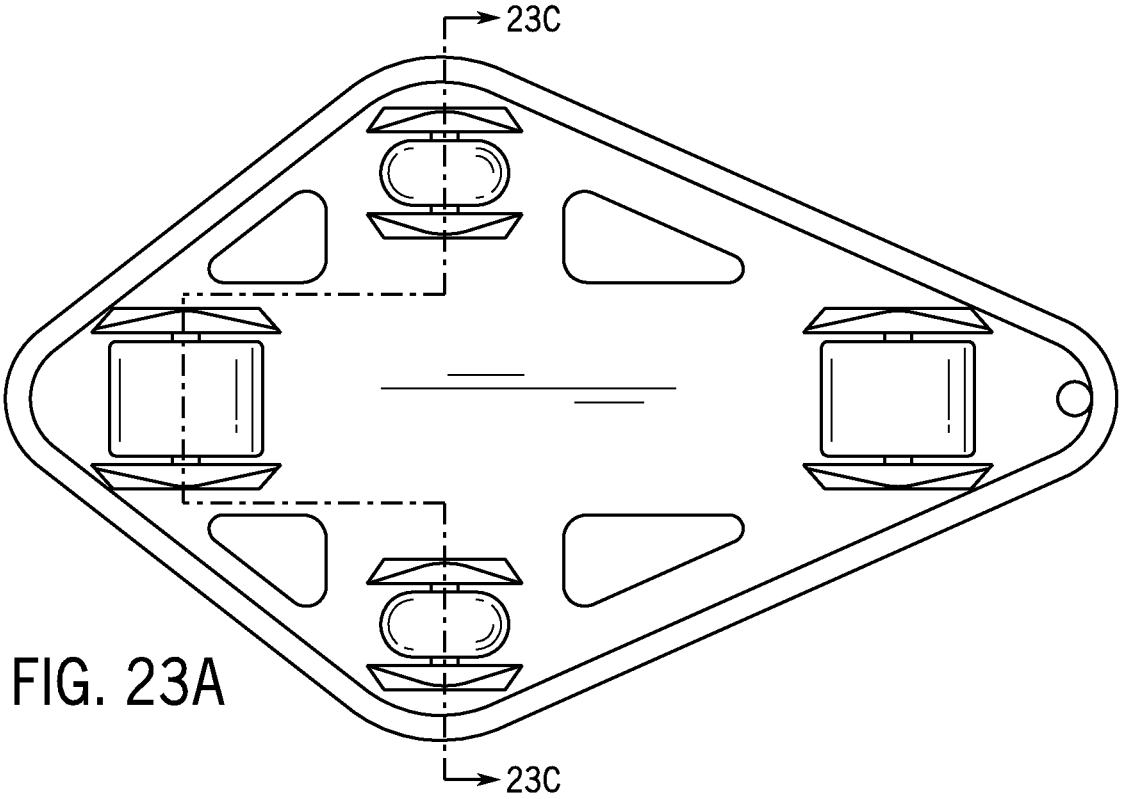
Figure 23B:
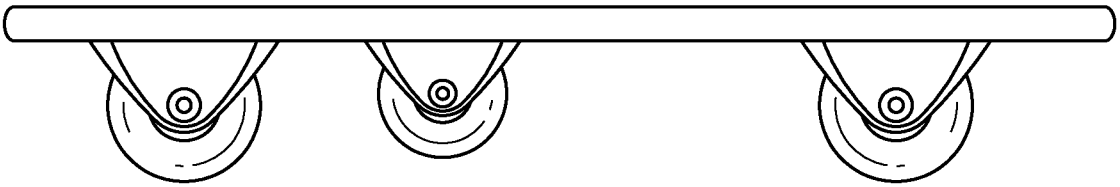
Figure 23C:
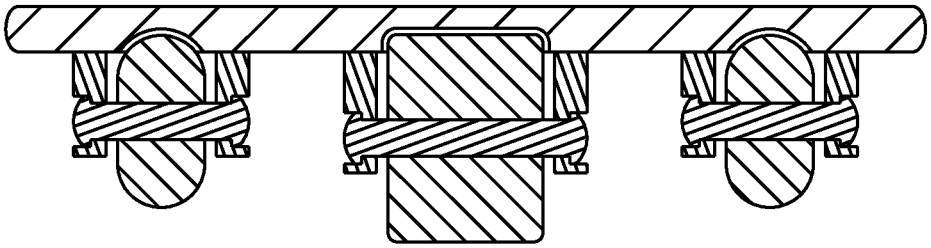

FIG. 23A, 23B, 23C illustrate another configuration which includes at least two center wheels. In addition, the configuration has at least on lateral wheel on each side of the center wheels. The lateral wheels are a small diameter or set further into an opening or recessed area in the bottom of the board. This allows the apparatus to function using the center wheels only or by shifting weight to either side to engage the smaller lateral wheel(s) thus improving maneuverability and turning ability.

Figure 24A:
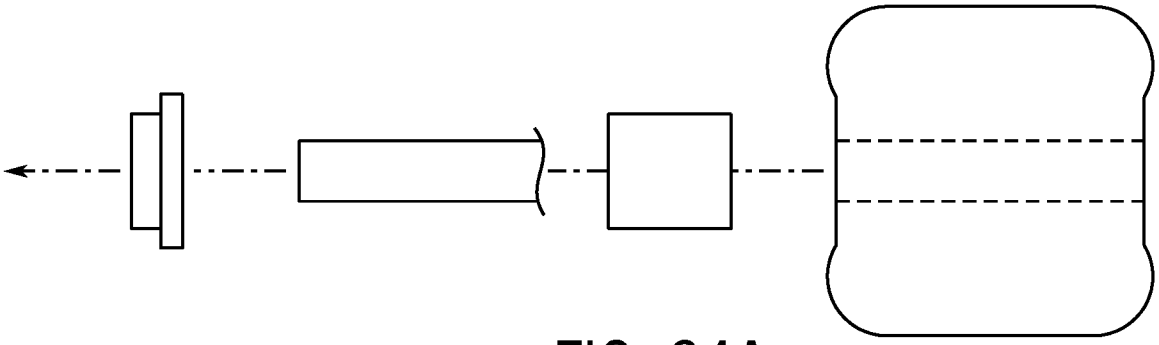
Figure 24B:
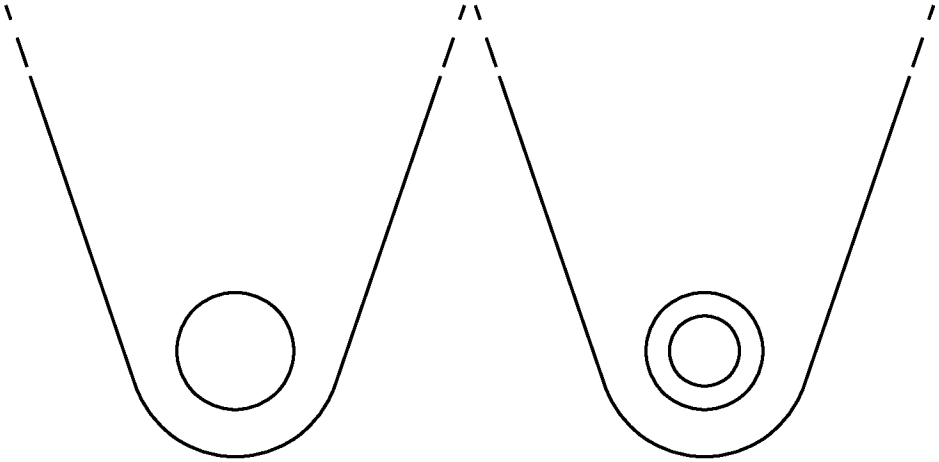

FIG. 24A, 24B illustrate a construction in which a polymer or other such dense material used for shock absorption is molded into a donut shape with a flanged edge. The flanged rings slide over the axles on each side and fit into an opening on the wheel support bracket to secure its position. This provides both shock absorption when traveling over bumps and cracks and additional maneuverability when the user's weight shifts to one side and slightly compresses the ring.

DETAILED DESCRIPTION

It should be understood at the outset that although an exemplary implementation of the present invention is illustrated within, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

Figure 19:
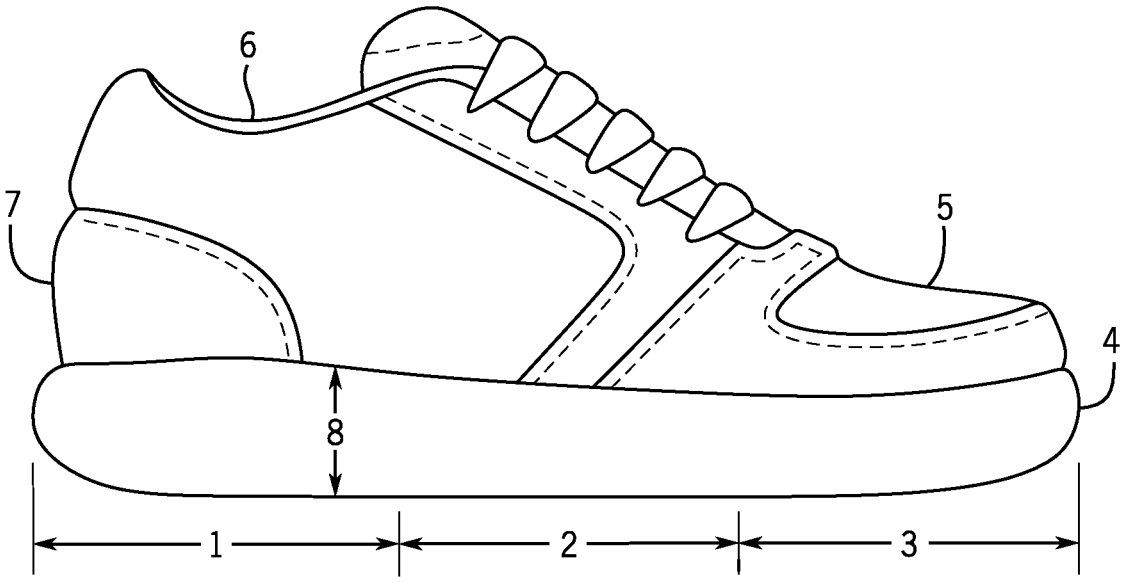
FIG. 19 illustrates a configuration of a basic shoe and attempts to identify the various sections of the footwear.

The athletic shoe (FIG. 19), as is true of most footwear, may be generally described as having the sole 4 and an upper part 5. The upper part may be constructed of virtually any material such as, for example, leather, plastic, or canvas. The sole may include three parts: an innersole or insole 6 a midsole 8; and an outer sole or outsole 4. The insole may provide added cushion and may or may not be removable. The outsole 4 will preferably be made of a durable material such as rubber, and may have a textured surface such as textured or raised bumps, to provide added traction. The midsole 8 will generally be constructed of a softer "cushiony" material and will generally be thicker than the insole and the outsole 4. In some embodiments, however, the sole 4 will comprise only one part, such as the leather sole of a loafer. In other embodiments, the sole may include a separate heel or wedge that elevates the rear portion of the footwear, such as the heel of a leather wingtip dress shoe or wedge. This heel or wedge 8 may be considered to be part of the heel portion of the sole. It should be understood that the present invention might be implemented in virtually any footwear, irrespective of the design or the make-up of the sole. Various styles of footwear and methods of making footwear are known in the art and are known by one of ordinary skill in the art.

In most footwear, including the athletic shoe (FIG. 19), the sole may also be divided into three portions or regions: (1) the heel portion, (2) an arch portion, and (3) a forefoot portion. It should be understood that 1) the heel portion, (2) an arch portion and (3) a forefoot portion of the sole are incapable of being exactly defined and located, and that such portions vary from one footwear type to another. Thus, the location, the boundaries between, and the size of the heel portion, the arch portion, and the forefoot portion of the sole are only rough approximations.

The wheel may be constructed or made of virtually any known or available material. Such as, for example, a urethane, a plastic, a polymer, a metal, an alloy, a wood, a rubber, a composite material, and the like. This may include, for example, aluminum, titanium, steel, and a resin. Preferably, the material will be durable, provide quiet performance, provide some traction on the surface and will provide a soft or cushioning feel.

The wheel and the wheels are illustrated as cylindrical wheels. These wheels, however, may be provided in virtually any available configuration. Further, one or more wheels may be positioned in a section of the board.

Figure 1A:
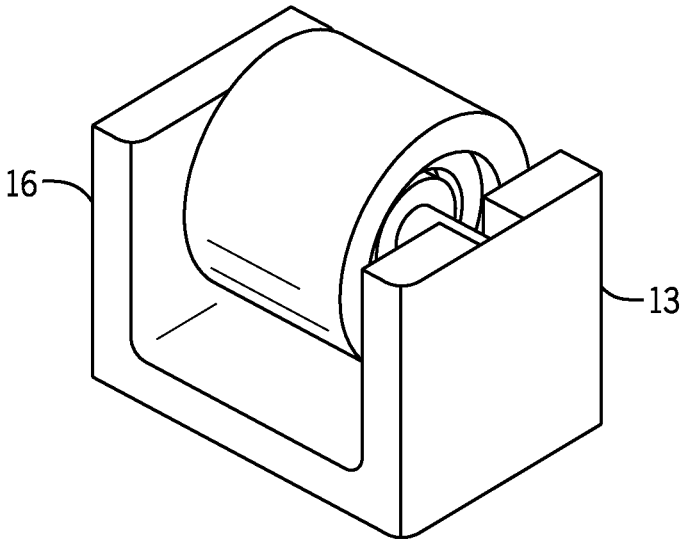
FIG. 1A is a perspective view that illustrates a wheel rotatably mounted to an axle, which also may be referred to as a wheel/axle assembly, for use in a wheel assembly according to one embodiment of the present invention.
Figure 1B:
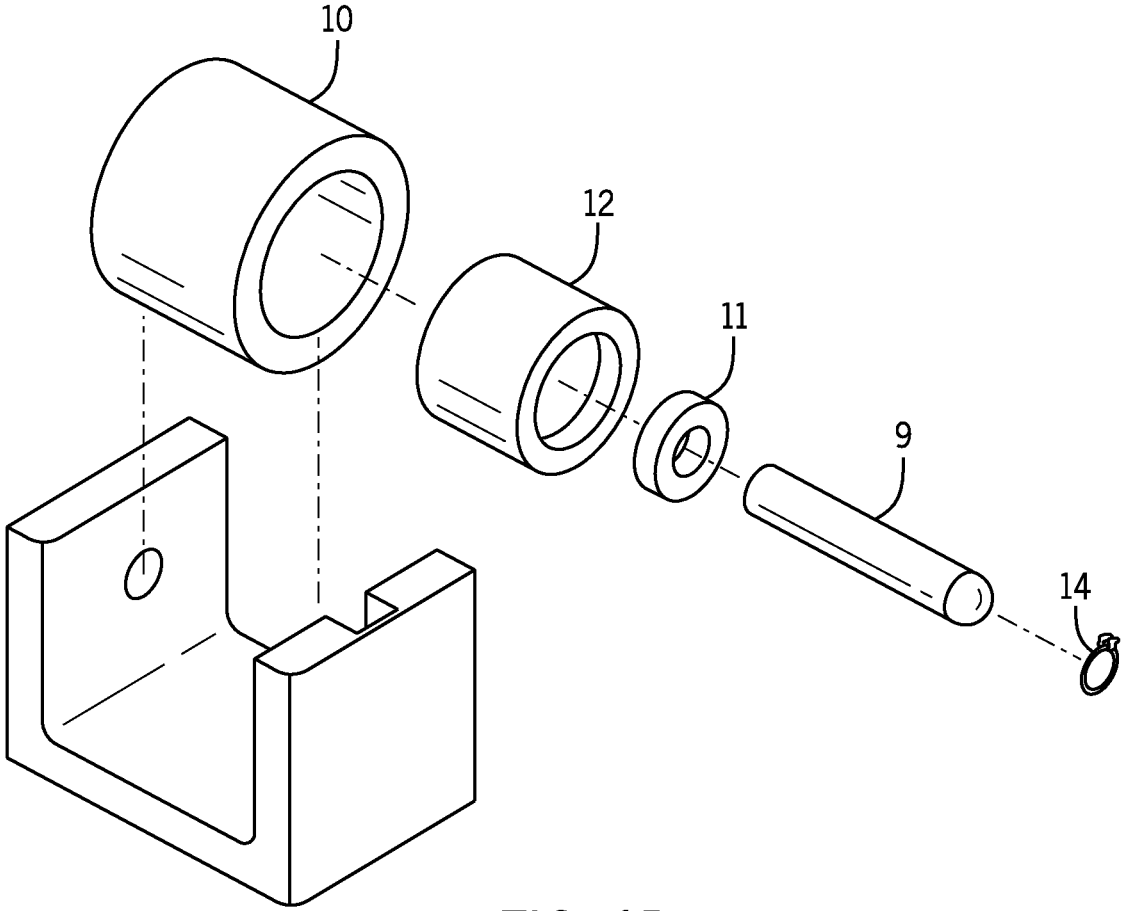
FIG. 1B is perspective views that illustrates a mounting structure for use with a wheel rotatably mounted to an axle, as illustrated to form a wheel assembly.
Figure 2A:
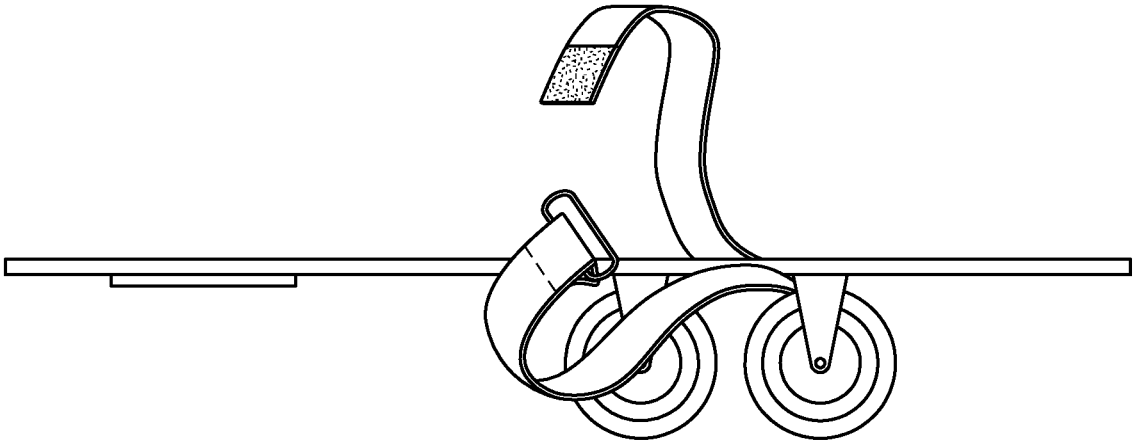
FIG. 2A is a side view that illustrates one embodiment of a wheeled platform apparatus with an attachment structure such as adjustable strap or straps.
Figure 2B:
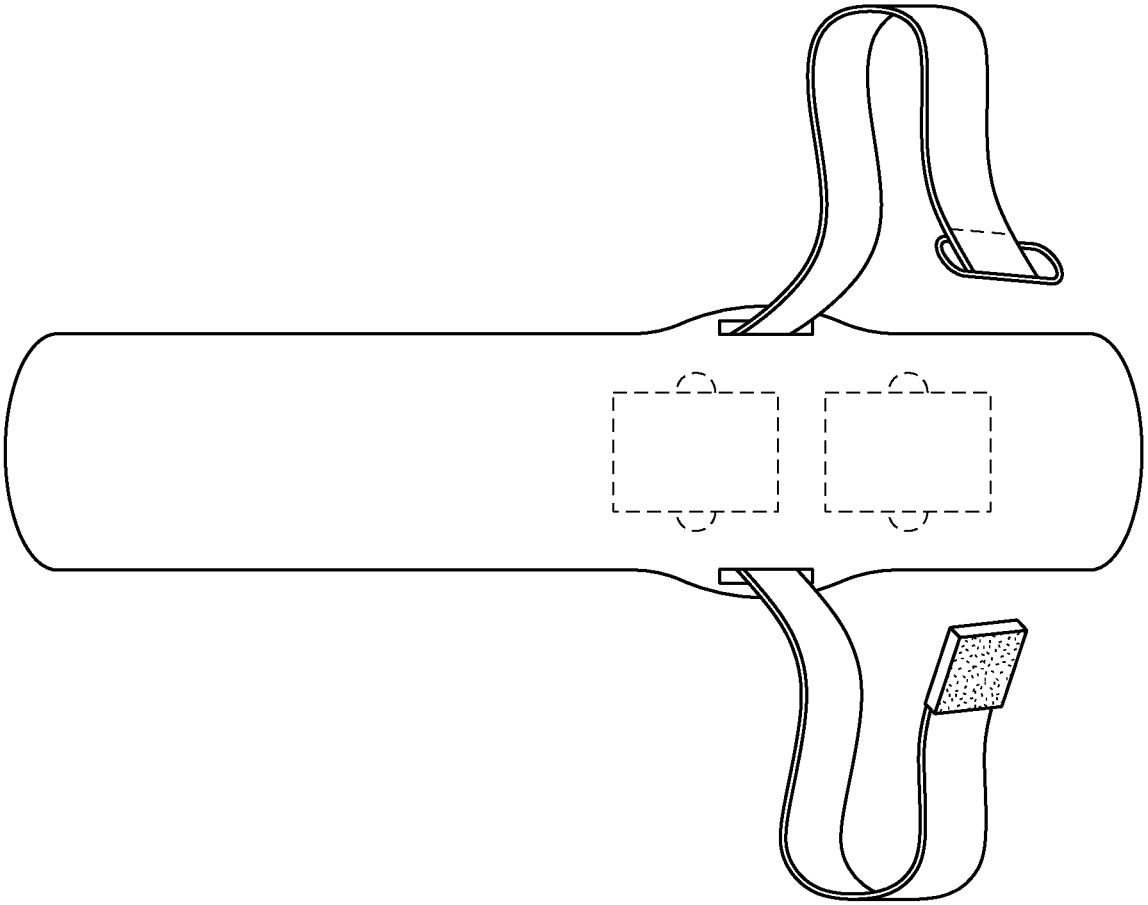
FIG. 2B is a top view that illustrates an embodiment of a wheeled platform apparatus with an attachment strap or straps.
Figure 2C:
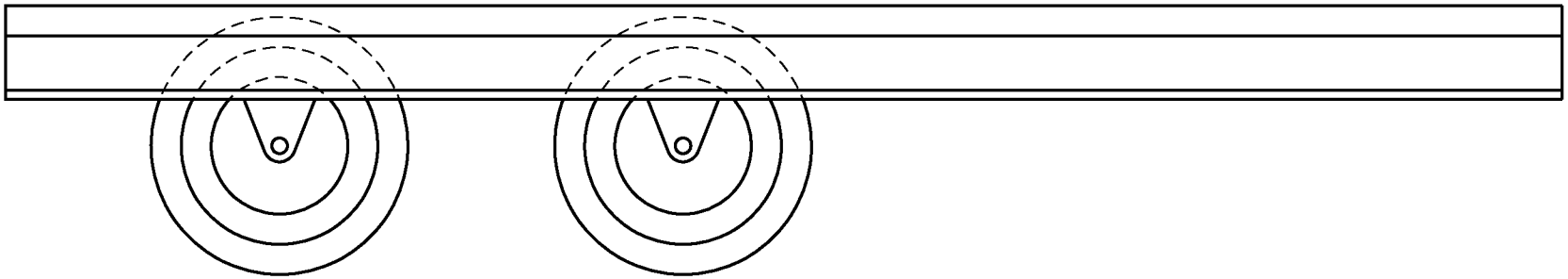
FIG. 2C is a side view that illustrates one embodiment of a wheeled platform apparatus with the wheels recessed into or through an opening in the platform.
Figure 3A:
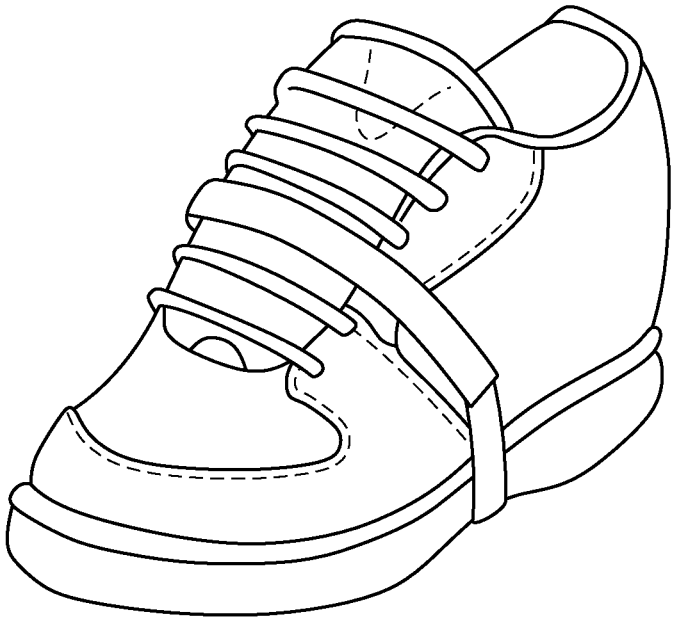
FIG. 3A is a front, isometric view that illustrates one embodiment of a wheeled platform apparatus with an attachment strap connecting user to wheeled apparatus.
Figure 3B:
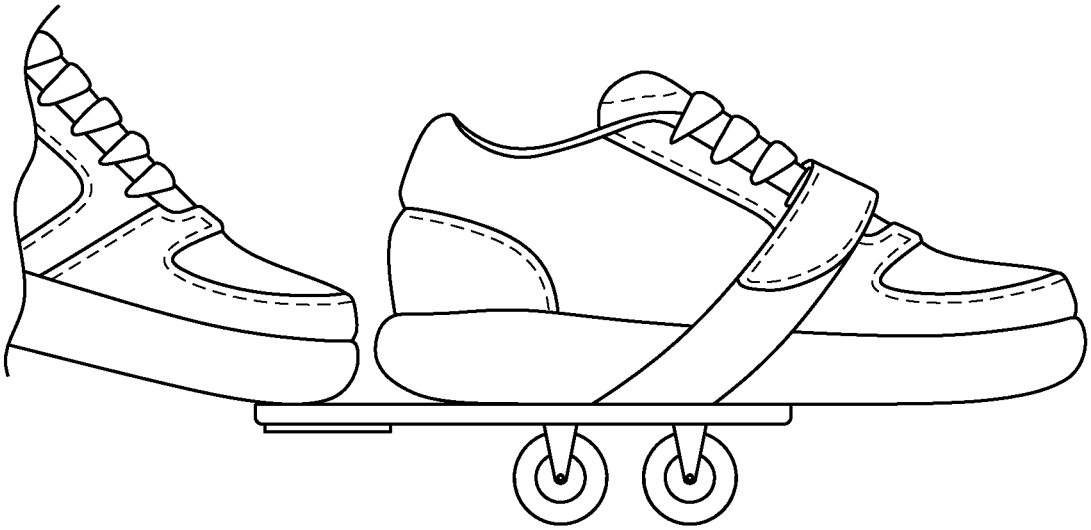
FIG. 3B is a side view that illustrates one embodiment of a wheeled platform apparatus with an attachment strap connecting user to wheeled apparatus.
Figure 4A:
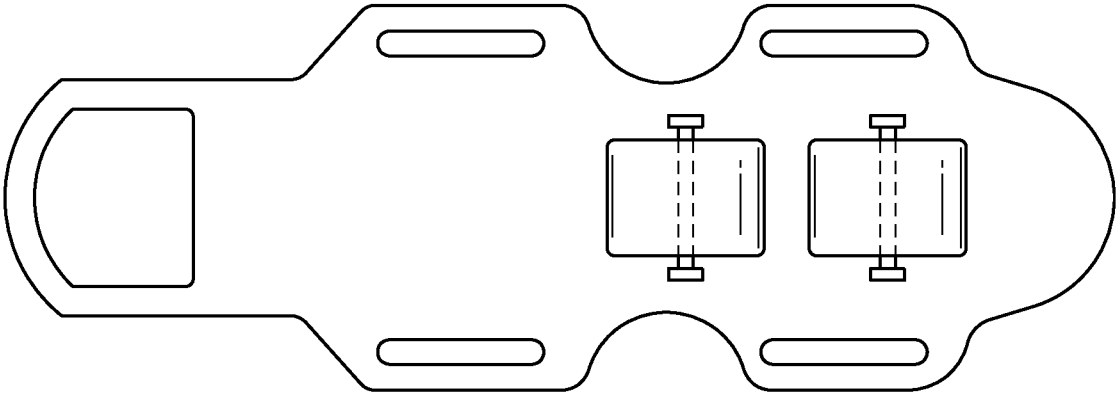
FIG. 4A is a bottom view that illustrates one embodiment of a wheeled platform apparatus demonstrating how the apparatus can be made to accommodate attachment straps thereby giving the user an option to use the apparatus with or without attachment straps.
Figure 4B:
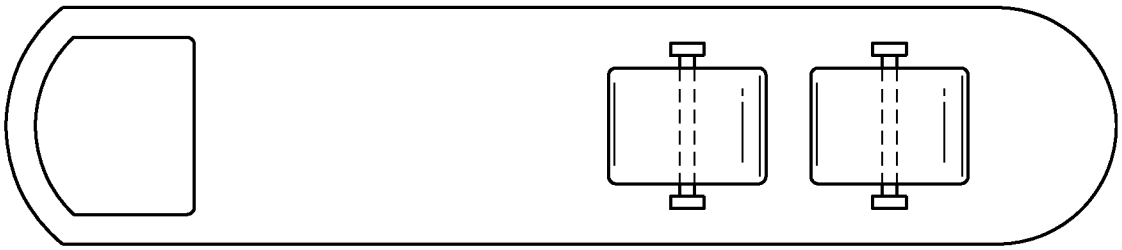
FIG. 4B is a bottom view that illustrates one embodiment of a wheeled platform apparatus that does not offer the user an option to use the apparatus with attachment straps.

FIG. 1B further illustrates other elements of the wheel assembly that include a first member and a second member of a mounting structure that is used to removably couple with an axle 9. The axle 9 extends through the wheel 10 such that the wheel is rotatably coupled or mounted to the axle 9. This preferably involves the use of precision bearings 11, such as high performance precision bearings 11, provided in a recess 12, such as an annular recess 12, one side of the wheel. A first precision bearing 11 and a second precision bearing 11 may be ABEC grade precision bearings and are illustrated with hidden lines and positioned in the first recess 10 and second recess 12 of the wheel.

The axle 9 may be made of any material that provides suitable physical characteristics, such as strength and weight, to name a few. The axle 9 is preferably made of hardened steel, is cylindrical in shape, each end is rounded, and is removably or permanently coupled with a first member and a second member, respectively, of the mounting structure 13, 16. The removable or permanent coupling between each end of the axle and the first member and these members may be achieved by any known or available mechanism.

It should also be noted that because the weight of the user of the apparatus will exert a significant downward force and the ground or surface will exert an equal force upward, the axle 9, and, hence, the wheel 10 will generally be forced into place. Thus, the present invention does not require a large side force to keep the axle 9 and the wheel 10 in place.

FIG. 1B Shows a "c-clip" 14, slip ring 14, or ring clip 14 is positioned around, or nearly around, the axle 9 near the precision bearing 11. This serves to ensure that the precision bearing 11 remains in place in the recess of the wheel 12. The slip clip 14 or ring clip 14 will preferably be positioned on the axle 9 through a groove. Such as a radial groove or radial indentation, in the axle. It should be understood, however, that one of ordinary skill in the art may use any of a variety of other arrangements to ensure that the precision bearing 11 stays in position. In alternative embodiments, the precision bearing 11 may be eliminated or loose bearings may be used.

FIG. 1A is a perspective views of a wheel assembly that includes the wheel 10 rotatably mounted to the axle 9.

It should be understood that the axle 9 may couple to a member of a mounting structure using any available technique and in virtually an unlimited number of ways. For example, an axle may couple to the first member and the second member by way of a threaded axle and bolt. A mounting structure may move from a retracted position to an extended position through a spring arrangement.

Figure 5A:
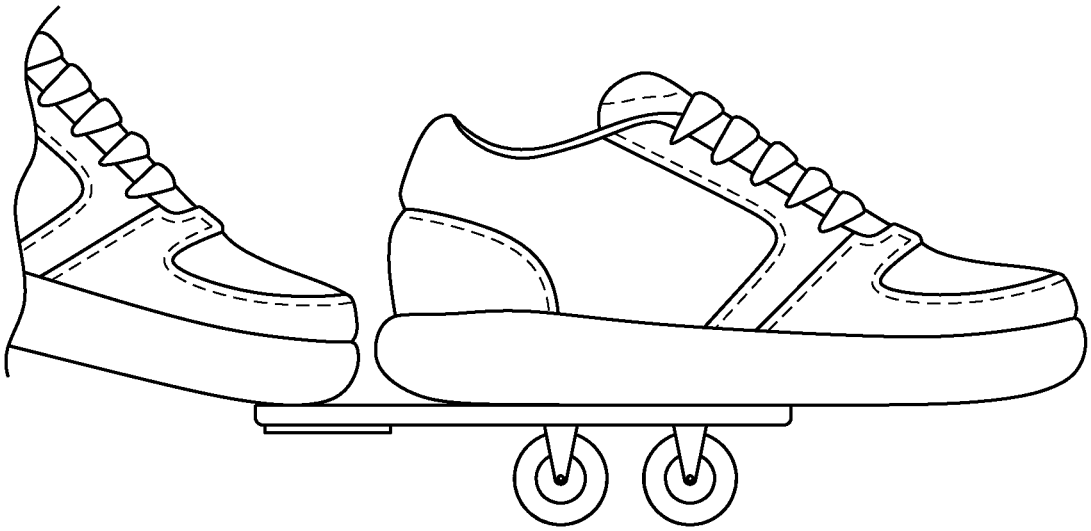
FIG. 5A is a side view that illustrates one embodiment of a wheeled platform apparatus without an attachment showing the front foot position on the surface of the apparatus and the second foot resting on the back of the apparatus above the braking area.
Figure 5B:
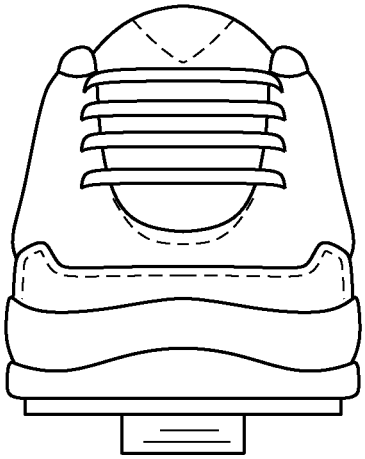
FIG. 5B is a front view that illustrates one embodiment of a wheeled platform apparatus without an attachment.
Figure 8A:
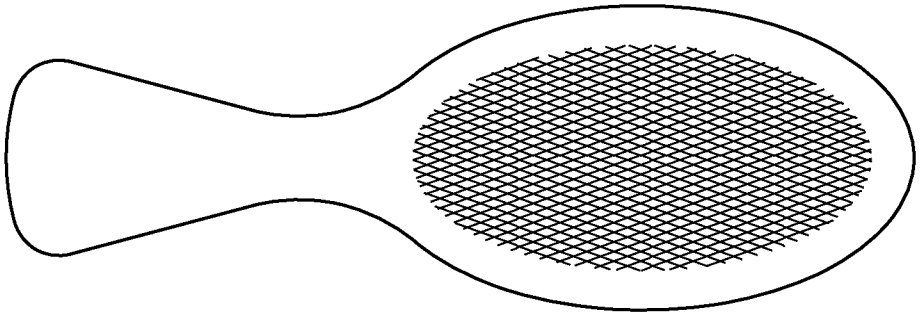
FIG. 8A, 8B are top views that illustrate embodiments of a top surface of the wheeled platform apparatus demonstrating different shapes to the top surface and footrest to maximize comfort, stability and ease of use along with friction tape or textured surface to secure foot contact with the board's top surface.
Figure 8B:
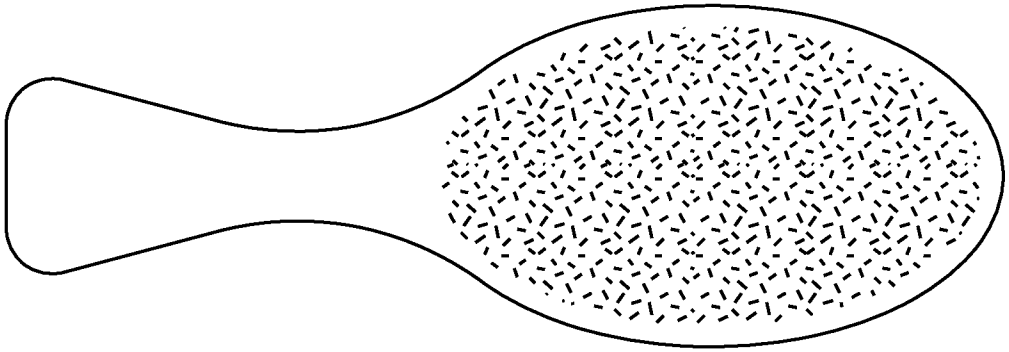
Figure 9A:
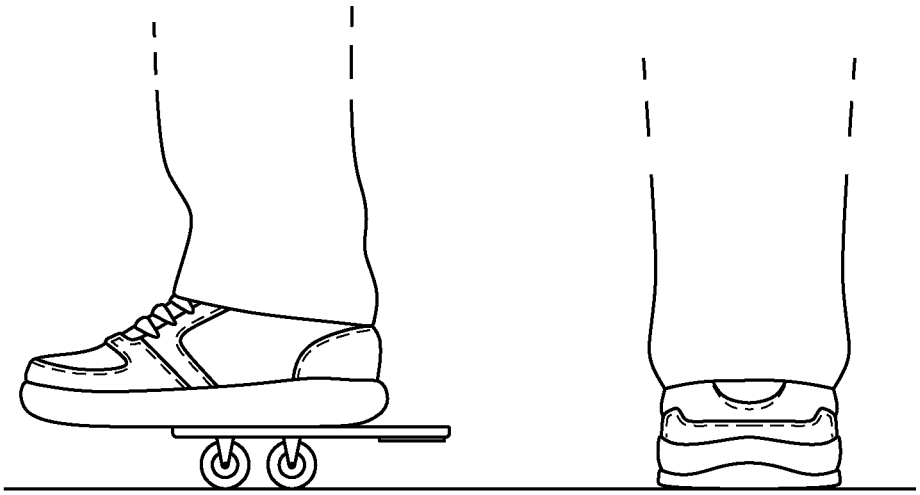
FIG. 9A, 9B is a side view that illustrates user's foot position on the board for optimum use of wheeled apparatus.
Figure 9B:
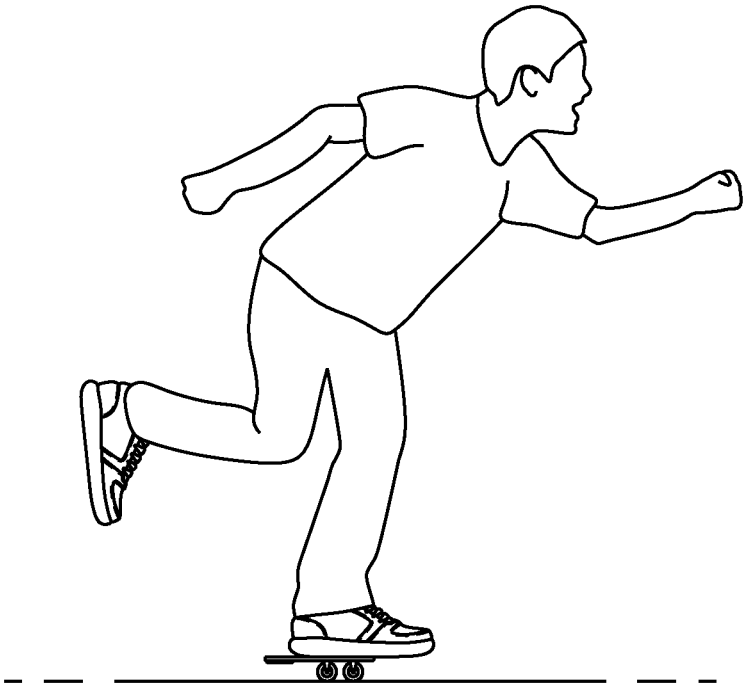
Figure 10A:
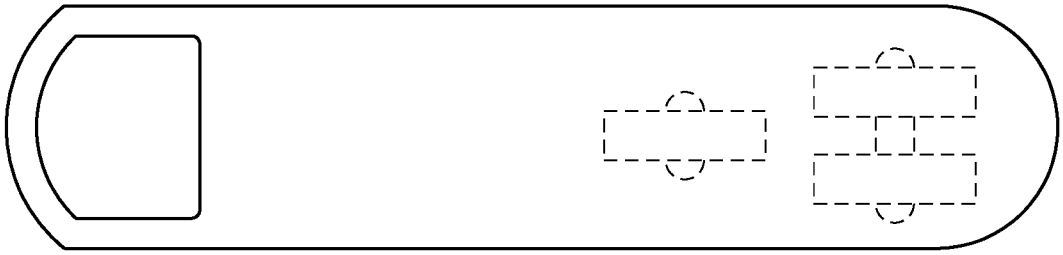
FIG. 10A, 10B, 10C are bottom views that illustrate various embodiments of a wheeled platform apparatus with examples of several different wheel configurations to maximize comfort and performance and ease of operation for the user.
Figure 10B:
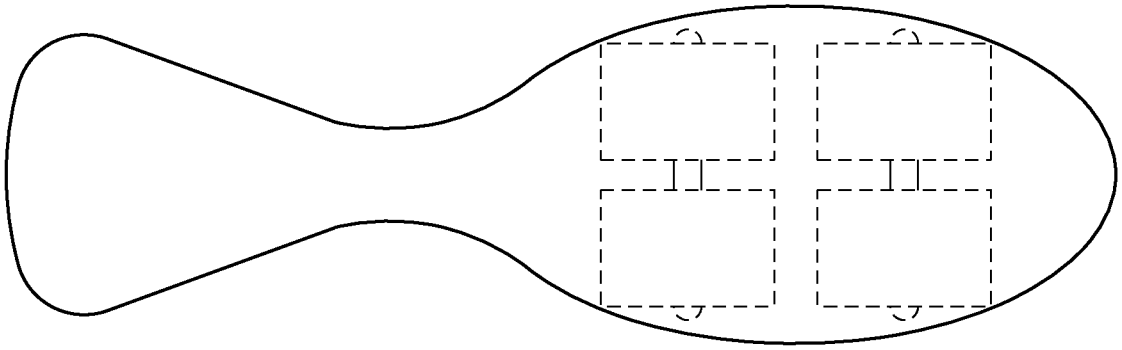
Figure 10C:
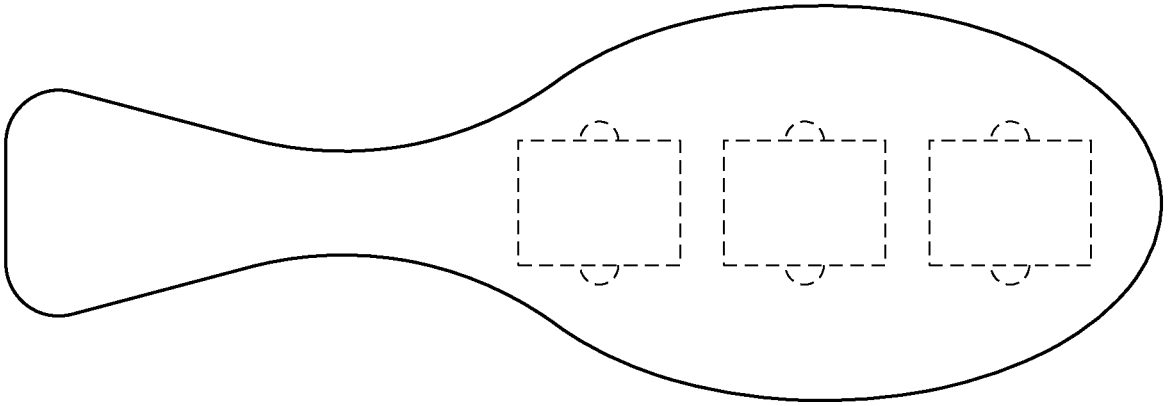
Figure 11A:
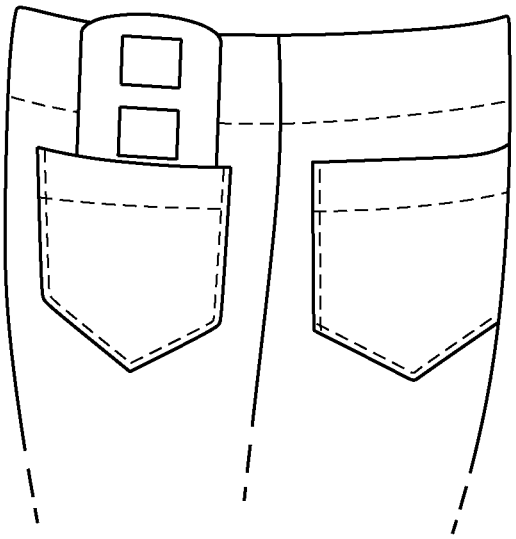
FIG. 11A, 11B are illustrations that demonstrate the uncharacteristically small size of the wheeled platform apparatus encouraging the user to store the apparatus in the user's pocket, belt loop holder or backpack in a convenient manner when not is use.
Figure 11B:
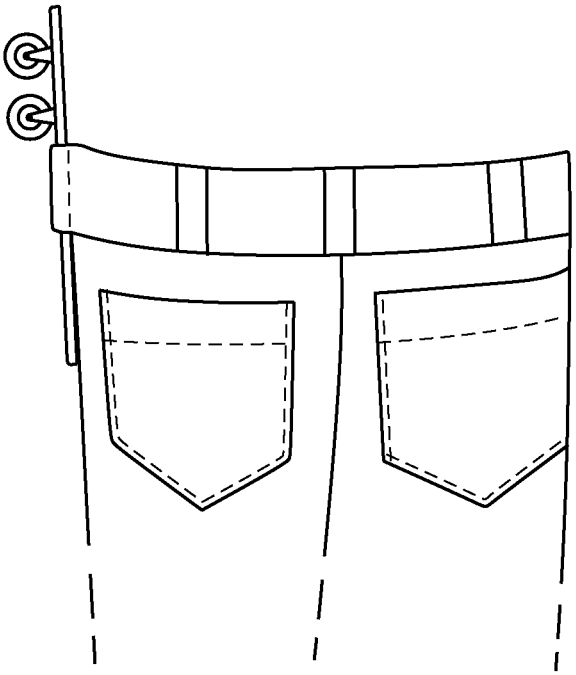

FIG. 5A, 5B illustrates a method for use of the wheeled platform apparatus 30 on a surface by a user, wherein the user positions a first foot on the wheeled platform apparatus and moves on the surface in a first direction (i.e., rolling direction of the wheeled platform apparatus 30) by placing at least a portion of the second foot in contact with the surface and kicking or pushing the portion of the shoe to provide force in the first direction.

FIG. 6 illustrates a side perspective view of a wheeled platform apparatus according to one embodiment. The wheeled platform apparatus preferably includes a platform 22, 23, 24, which operates as a chassis, having a rear portion which may also be referred to as a back portion 22, a center portion which may also be referred to as a mid portion 23, a front portion 24, a top which may also be referred to as an upper surface 25, and a bottom surface 26.

In some embodiments, the platform may be made of metal, wood, bio fiber, plastic, polymer, ceramic, composite, acrylic, renewable, recycled, or other suitable materials capable for supporting a user's weight as intended or desired.

Referring again to FIG. 6 in some embodiments, the first wheel 27 and the second wheel 28 may be positioned at least partially along a longitudinal center line 29 of the platform that extends from the rear portion 22 to the front portion 24 along the center 29 of the platform, as further illustrated, for example, with the first wheel 27 being positioned in the front portion 24 of the platform and the second wheel 28 being positioned in the center portion 23 of the platform.

In other embodiments, the wheels may be positioned or configured in virtually any known or desired position, including both in the front section 24, side-by-side, inline. For example, when the first wheel 27 and the second wheel 28 are positioned adjacent to the bottom surface 26 of the platform in a manner such that both wheels reside below the area of contact between the wheeled platform apparatus and the user's foot, the user's safety and control of the wheeled platform apparatus is enhanced based at least partially upon the user's ability to steer the wheeled platform apparatus with one foot. Further, it should be understood that the wheeled platform apparatus may include wheels in addition to the first wheel 27 and the second wheel 28.

In other embodiments the first wheel 27 and/or the second wheel 28 may be permanently attached, removable, or retractable to the platform 30.

In other embodiments, the first wheel 27 and/or the second wheel 28 may be attached to the wheeled platform 30 apparatus by a friction fit, snap fit or other suitable fit including this as described above.

In other embodiments, the first wheel 27 and/or the second wheel 28 may be a wheel attached to a swivel capable of orienting in a full 360 degree spectrum on a vertical axis for directional rolling, also known as a caster wheel. Other types of wheels capable of orienting along at least a portion of a 360-degree spectrum may also be used. Such as a ball bearing or spherical trackball.

In yet other embodiments, the first wheel 27 and/or second wheel 28 may be illuminated, via one or more LEDs or other illuminating device, by battery power, induction power, or other suitable means for powering an illumination device.

In other embodiments, for example, positioning the user's footwear or bare foot primarily along the longitudinal centerline 29 of the platform 30 may occur at an angle less than plus or minus 45 degrees from the rolling direction or the longitudinal centerline 29 of the wheeled platform apparatus 30. Other angles are possible and in a manner of the user's preference.

The top surface 25 of the wheeled apparatus may be knurled or otherwise textured for enhancing grip with the user's foot or footwear, thereby enhancing control of the wheeled platform apparatus 30 by the user. Such enhanced control contributes to increased usability by the user for directional steering, performing stunts, maneuvers, and tricks with wheeled platform apparatus 30, and further enhances safety. In still other embodiments, the top surface 25 may have graphics or colors for enhancing aesthetic appeal.

In other embodiments, the top surface 25 may be made of or include a shock absorbing material. such as polymer, gel, rubber, foam or other substance, for providing shock absorption and/or suspension for the wheeled platform apparatus 30 and the user.

In yet other embodiments, the deck plate 25 may include a shock absorbing material. Such as gel, rubber, liquid, encapsulated pockets of gas, foam, or other suitable substance, capable of absorbing mechanical forces, shock and/or providing suspension for the wheeled platform apparatus 30 and the user.

In still other embodiments, a shock absorbing material such as gel, rubber, liquid, encapsulated pockets of gas, foam, or other suitable substance, may be partially or fully embedded within the top surface 25, or may be positioned adjacent to the top portion 25 for providing shock absorption and/or suspension for the wheeled platform apparatus 30 and the user.

In yet other embodiments, the platform may house illumination devices, such as LEDs or lights, for illuminating the wheeled platform apparatus 30. The illumination devices may be powered by battery power, solar power, or other suitable power means.

In yet other embodiments, the illumination devices may be powered by induction motors built into or in conjunction with the first or front wheel and/or the second or rear wheel.

FIG. 7A, 7B illustrate embodiments of the wheeled platform apparatus 30 having a footrest 31, 32 positioned adjacent to the rear portion of the wheel apparatus 30. The footrest 31, 32 may be mounted adjacent to the wheeled apparatus 30. This allows a user to roll greater distances with less effort.

I[illegible] some embodiments, the footrest 31, 32 extend horizontally or downwardly from the rear portion of the platform.

FIG. 7A, 7B illustrates some embodiments where by the rear footrest 31, 32 can be adjusted to be repositioned in various positions around the back of the wheeled apparatus 30 in order to enhance comfort and meet the specific and unique preference of a user.

In other embodiments, the footrest 31, 32 may be used as a braking surface 36 by shifting the user's weight on the platform 30 to raise the front portion and first wheel 27 of the platform there by downwardly angling the rear portion 22 of the platform, which brings the underside of the footrest 31, 32 into contact with the surface upon which the wheeled platform apparatus 30 is rolling (i.e., concrete, asphalt, etc.) This interface between the underside of the footrest 31, 32 and the rolling surface creates friction, thereby slowing the rolling of the wheeled platform apparatus.

In yet other embodiments, the footrest 31, 32 may have a braking structure 36 including a surface of rubber, plastic, or other suitable material, positioned at least partially adjacent to the permanent portion of the platform.

In some embodiments the brake pad 36 can be replaced once the brake material wears down through repeated abrasion with the ground surface.

Figure 12A:
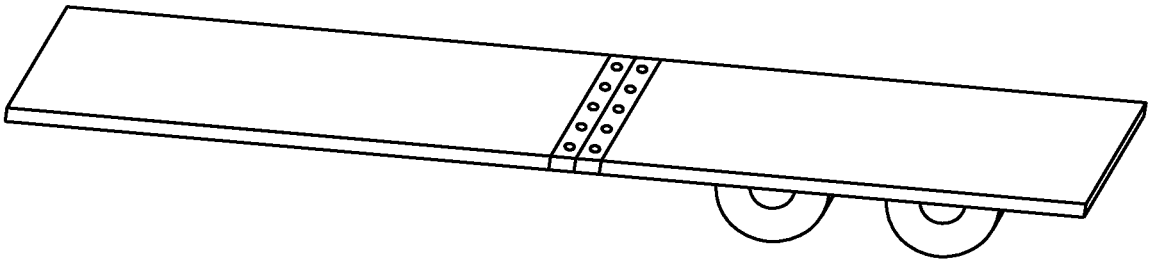
FIG. 12A, 12B, 12C are illustrations that demonstrate a hinged or bendable joint connecting two portions of the wheeled apparatus platform so the device can be folded or collapsed to further reduce the size for convenient storage and transport while maintaining maximum dimensions for optimum performance while in use.
Figure 12B:
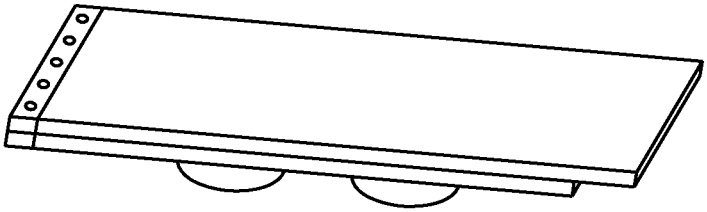
Figure 12C:
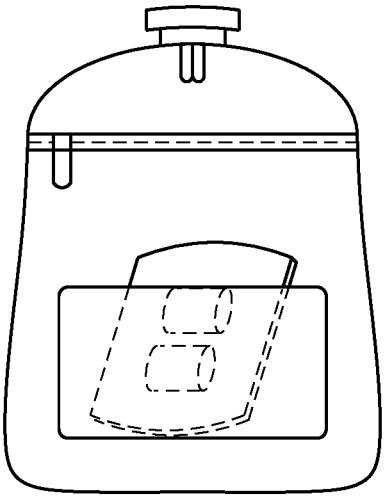

FIG. 12A, 12B, 12C illustrate yet other embodiments whereby the wheeled apparatus can is constructed with a hinge or other such bendable joint attachment allowing for the apparatus to be folded or otherwise minimized in size and shape for easy storage and transportation.

Figure 13A:
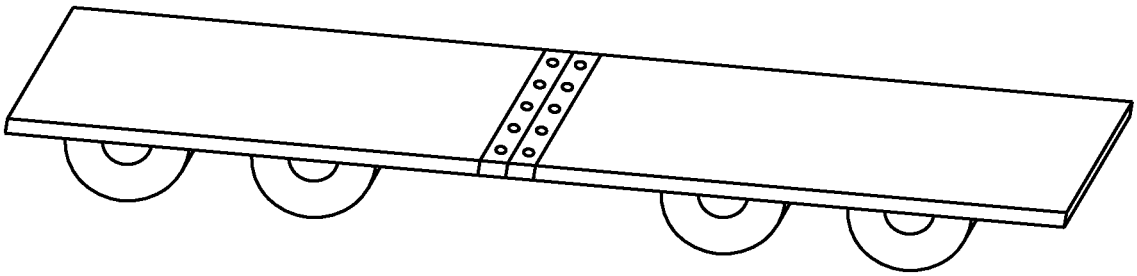
FIG. 13A, 13B are illustrations that demonstrate a hinged or bendable joint in which wheels are attached to both sections of the board for optimum performance while in use but allowing for overall size reduction for convenient storage and transport.
Figure 13B:
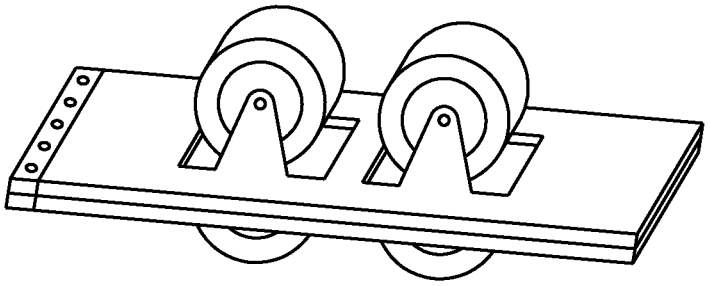

FIG. 13A, 13B illustrate a hinged bendable wheeled apparatus whereby the second section of the apparatus has an additional set of wheels to offer yet another option for stability and performance enhancement.

Figure 14A:
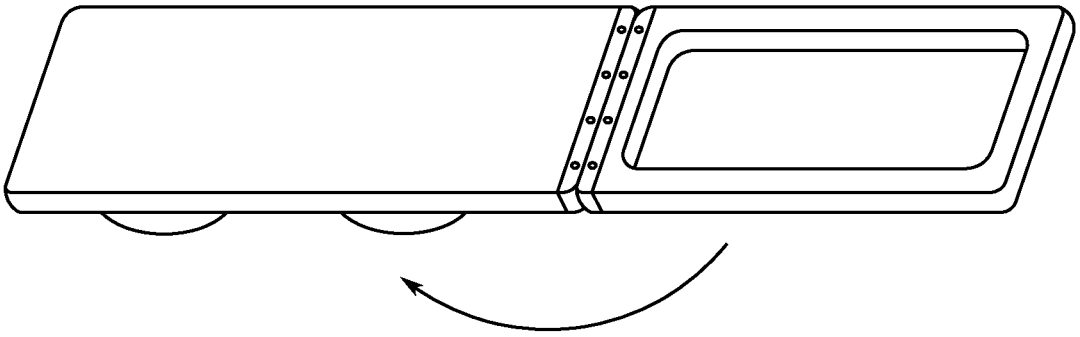
FIG. 14A, 14B, 14C are illustrations that demonstrate a hinged or bendable joint in which the rear section of the platform has a hollow center to allow the rear section to be folded over the wheels in the front section of the platform wheels to further minimize the overall size of the apparatus for convenient storage and transport.
Figure 14B:
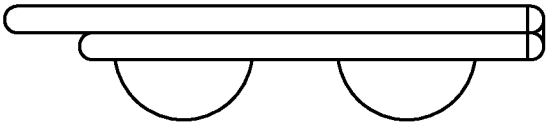
Figure 14C:
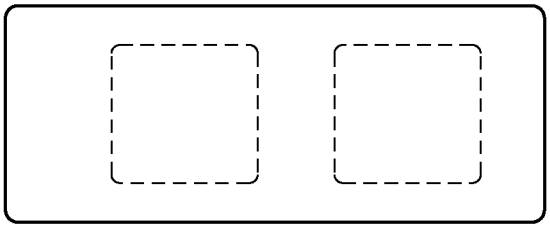
Figure 15A:
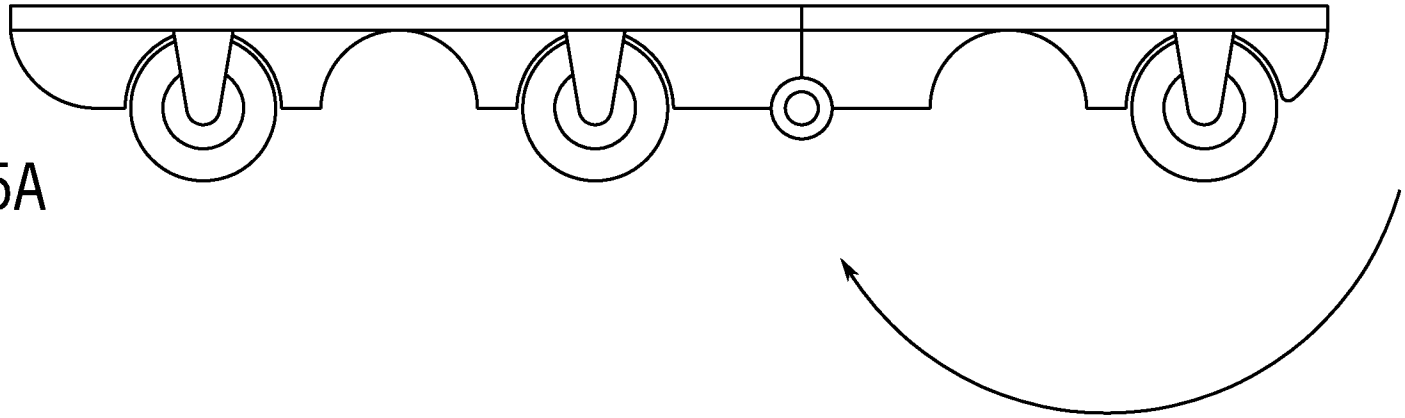
FIG. 15A, 15B are illustrations that demonstrate a hinged or bendable joint in which the front section of the platform has one or more recessed areas to allow the rear section to be folded into the front section of the platform allowing the wheels of both the front and back sections to nest securely together which minimizes the overall size of the apparatus for convenient storage and transport.
Figure 15B:
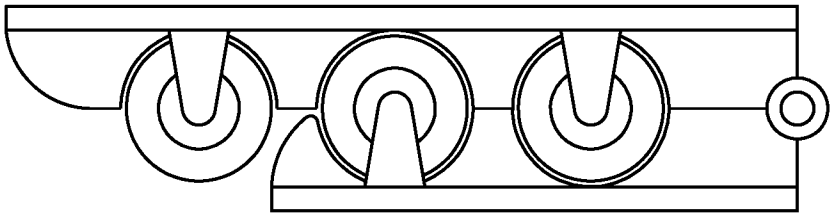

FIG. 14A, 14B, 14C illustrate a hinged or bendable wheeled apparatus whereby the second section of the apparatus has an opening that when folded down would fit over the wheels in the front section of the platform allowing for further convenience and reduced size for ease of storage and transport.

15A, 15B are illustrations that demonstrate a hinged or bendable joint in which the front section of the platform has one or more recessed areas to allow the rear section to be folded into the front section of the platform allowing the wheels of both the front and back sections to nest securely together which minimizes the overall size of the apparatus for convenient storage and transport.

Figure 16A:
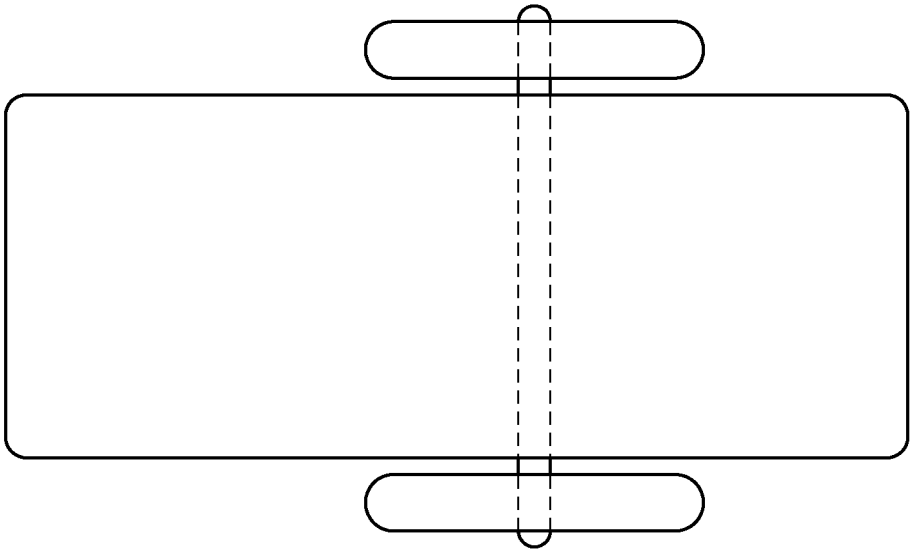
FIG. 16A, 16B are illustrations that demonstrate the ability to position the wheels off the side of the wheeled apparatus so the diameter, shape and position of the wheels are less restricted in diameter, thickness and profile of the wheels' shape. The platform may also include a wheel well to protect the foot from inadvertent contact with the wheel or wheels during skating.
Figure 16B:
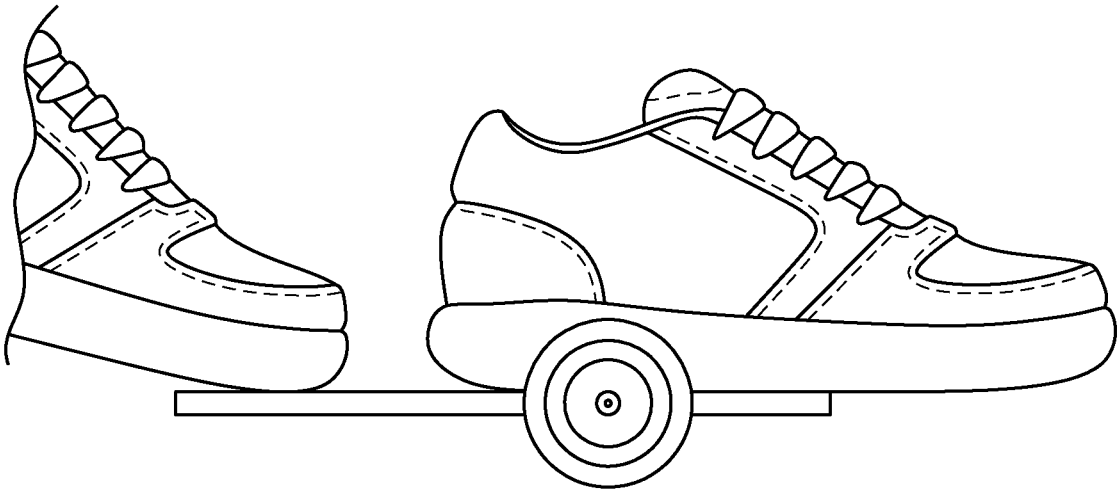

FIG. 16A, 16B illustrate yet another embodiment whereby the wheels are mounted to each side of the wheeled apparatus allowing for an increased diameter and rounded profile to the wheel. This can increase speed and efficiency when rolling over bumps and cracks.

Figure 17A:
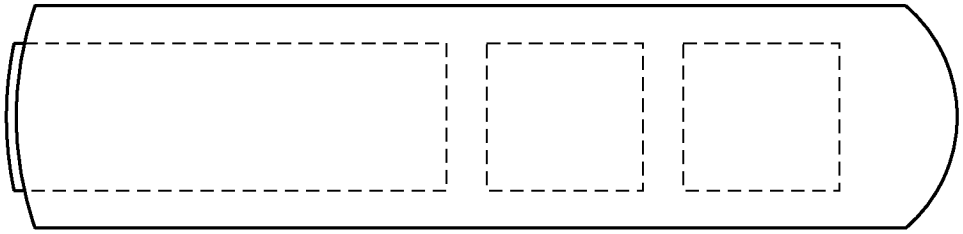
FIG. 17A, 17B illustrate another means of adjusting the size of the wheeled apparatus whereby the footrest portion can be retracted into the body of the wheeled apparatus platform to minimize the size for storage and transport and elongated for maximum benefit during use.
Figure 17B:
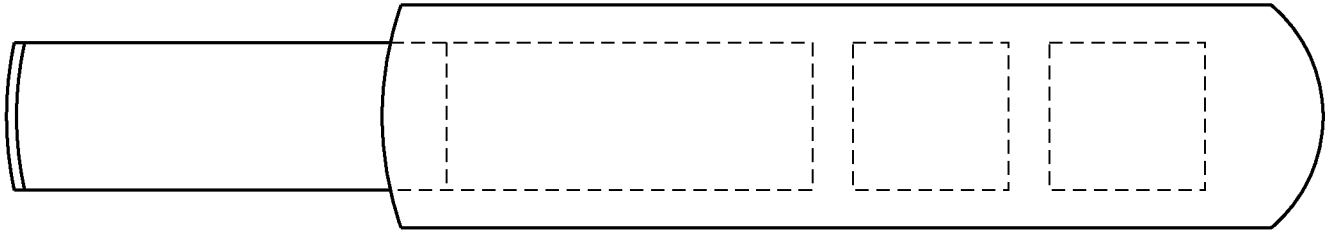

FIG. 17A, 17B illustrate yet another embodiment whereby the footrest can be retracted into the platform of the wheeled apparatus or extended out the rear portion of the wheeled apparatus platform in a manner that can create the most comfortable foot position for the user or retracted to minimize size and shape for storage and/or transport.

Figure 18A:
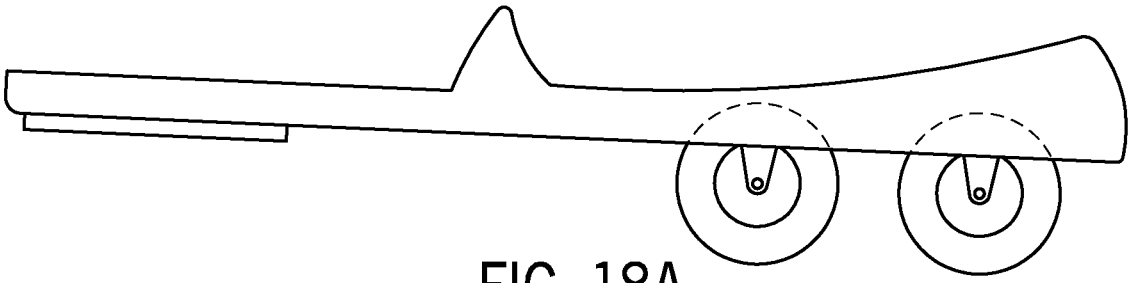
FIG. 18A, 18B illustrate a means of attaching wheels to the skating apparatus in a recessed manner in order to create a lower center of gravity thus adding a greater feel of stability and control. In addition, the forward or front portion of the top surface area has a raised cupped area to help stabilize the first foot during use.
Figure 18B:
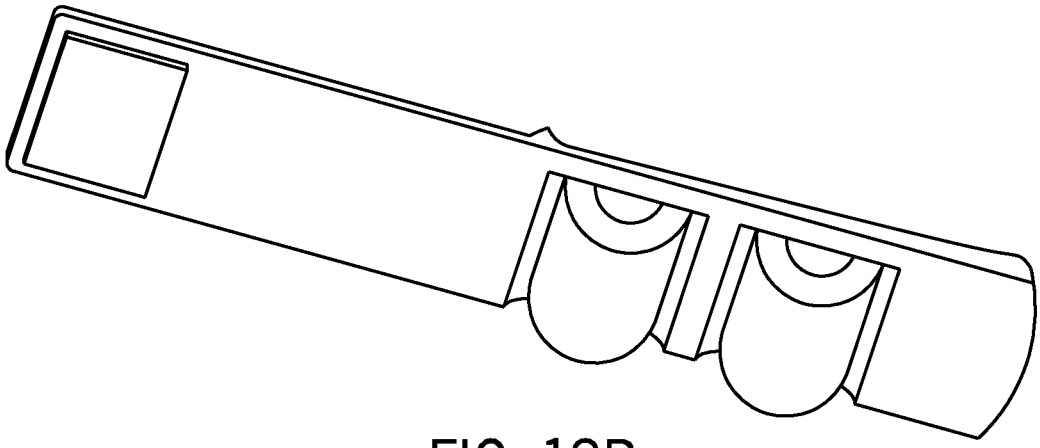

FIG. 18A, 18B illustrate a wheeled apparatus whereby the top surface of the skating platform has a raised and/or cupped portion that helps stabilize the front foot in an optimum position during skating.

Figure 18C:
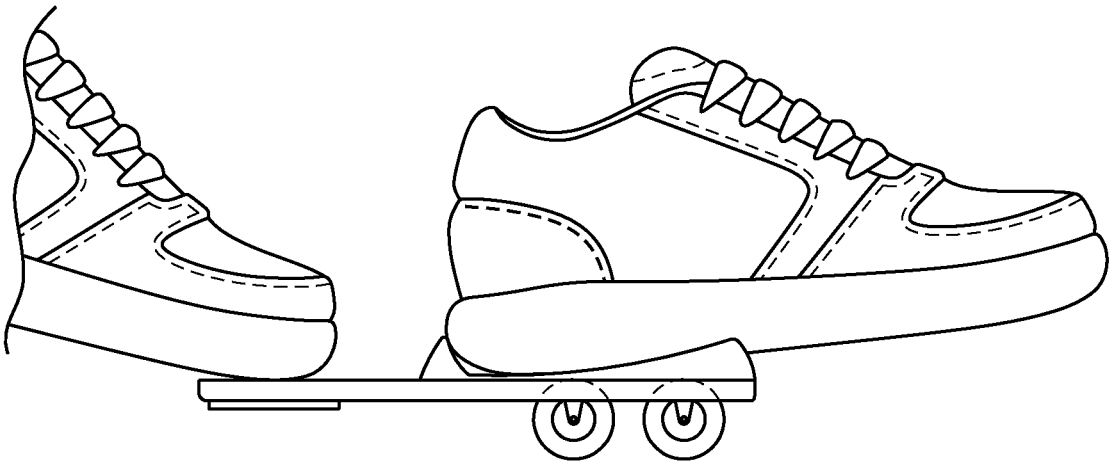
FIG. 18C illustrates the optimal foot position in which the front foot is elevated slightly. In addition, the heel area of the front foot rests in a cupped area to help properly position the front foot on the skating apparatus.

FIG. 18C illustrates the optimum foot position during use.

Figure 20A:
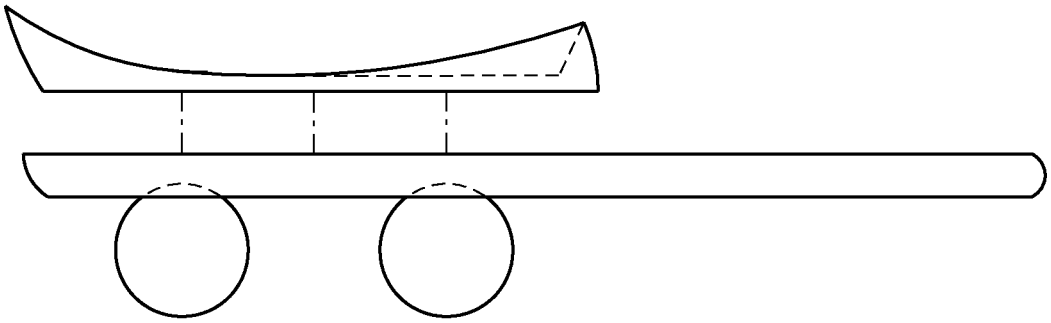
FIG. 20A, 20B illustrate a two-piece configuration for manufacturing ease whereby the foot frame portion can be molded separately and attached to a flat board maximizing the efficiency of the assembly process and providing varying options for suitable material choices based on performance need. In addition, graphics are added to the areas showing recommended positioning of heel and toe.
Figure 20B:
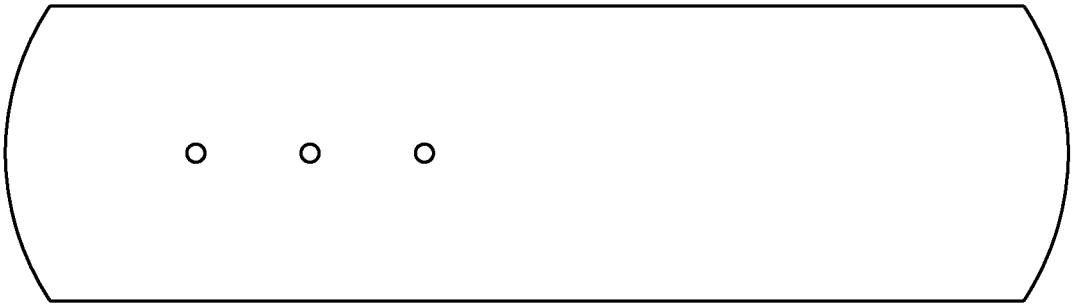

FIG. 20A, 20B illustrates a method of construction in which a foot frame can be molded separately and attached to the top surface of the apparatus.

FIG. 21 illustrates how a wheel positioned on the rear extension that is angled upward allows the user to perform certain maneuvers by shifting weight back to engage back wheel(s) and one wheel from the front or base portion of the apparatus.

FIG. 22A, 22B, 22C illustrates a wheeled platform apparatus in which a user can operate using center wheels or by shifting weight engage center wheels together with lateral wheel(s) which are angle such to engage the skating surface effectively.

FIG. 23A, 23B, 23C illustrates a wheeled platform apparatus in which a user can operate using center wheels or by shifting weight engage center wheels together with lateral wheel(s) which are of a smaller diameter and/or have an alternative shape such as a flatter or more rounded profile.

FIG. 24A illustrates how a flanged shock absorbing rings slide over the axle.

FIG. 24B illustrates how the flanged ring fits securely into an opening on the wheel bracket.

Stopping on the surface by placing at least a portion of the forefoot of one foot elevating the forefoot portion of the wheeled apparatus, thereby causing the underside of the footrest to interface with the surface causing a friction braking effect or by dragging at least a portion of the sole 4 of the footwear, such as the inside edge of the sole 4, along the surface.

In other embodiments, the transition from rolling on the surface to stopping on the surface may occur when either of both the first foot and the second foot intentionally come off the skating apparatus and run or walk to gradually slow momentum.

Thus, it is apparent that there has been provided, in accordance with the present invention, a wheeled platform apparatus and method. Although preferred embodiments have been described in detail, it should be understood that various changes, substitutions, and alterations can be made herein without departing from the scope of the present invention, even if some or all of the advantages identified above are not present. For example, the various elements or components may be combined or integrated in another system or certain features may not be implemented.

Also, the components, techniques, systems, sub systems, layers, compositions and methods described and illustrated in the preferred embodiment as discrete or separate may be combined or integrated with other components, systems, modules, techniques, or methods without departing from the scope of the present invention. Other examples of changes, substitutions, and alterations are readily ascertainable by one skilled in the art and could be made without departing from the scope of the present invention.

Various features many include:

A wheeled platform apparatus comprising: a platform having a front portion, a center portion also referred to as a mid portion, a rear portion also referred to as a back portion, a top surface, a bottom surface, and a longitudinal centerline; at least a first wheel and a second wheel interfacing with the wheeled platform apparatus and extending below the bottom surface of the platform or through an opening in the platform or into a recess in the platform to facilitate rolling movement of the platform and a footrest positioned adjacent to the rear portion of the apparatus for resting a portion of a second foot.

The wheeled platform apparatus wherein the first wheel and the second wheel are positioned along the longitudinal centerline of the platform.

The wheeled platform apparatus further comprising a strap or straps positioned to removably or permanently couple the first foot to the platform.

The wheeled platform apparatus wherein said attachment structure is operable to receive an axle.

The wheeled platform apparatus wherein said axle passes through an opening in said attachment structure.

The wheeled platform apparatus of wherein said axle is at least partially secured to said attachment structure by a tensioner or threaded bolt and nut.

The wheeled platform apparatus wherein said attachment structure is operable to be displaced relative to the surface of the platform to allow the first foot to be positioned at varying angles to the longitudinal centerline of the platform.

The wheeled platform apparatus further comprising a suspension member positioned between the wheel assembly and the platform.

The wheeled platform apparatus further comprising a light source positioned below the deck plate.

A method for use of a wheeled platform apparatus on a surface by a user, the method comprising:

- positioning a first foot on a wheeled platform apparatus operable to roll on the surface;
- positioning a forefoot portion of the first foot to extend over the front or side edge of the wheeled platform by a minimum of 25% of the total length of the foot;
- positioning a second foot to push off and propel wheeled platform.
- positioning second foot on footrest of wheeled platform once sufficient momentum is gained.

The method wherein the wheeled platform apparatus has a front portion, a center portion, and a rear portion and all or at least a portion of the forefoot of the first foot is extended over the front portion of the wheeled apparatus. The second foot after pushing off can rest on a footrest located adjacent to the rear portion of the wheeled platform apparatus.

A wheeled platform apparatus small enough to fit securely in the user's pocket, backpack or other means of easy transport when not in use.

A wheeled platform apparatus in which a footrest can be adjusted to at least three different positions to accommodate the specific preference of the user.

A wheeled platform apparatus that uses a hinging mechanism or other bendable attaching means to allow the apparatus to be folded into a more compact size and shape for easy storage and transportation when not in use.

A wheeled platform apparatus in which the wheels are attached to the side of the platform allowing for the use of a larger diameter wheel.

A wheeled platform apparatus in which the wheels are attached to the side of the platform allowing for the use of a larger diameter wheel with the axle positioned above the position of the foot on the platform.

A wheeled platform apparatus in which the wheels are attached to the side of the platform allowing for the use of a larger diameter wheel including a wheel well over the wheels to protect the foot from inadvertent contact with the wheels while in use.

A wheeled platform apparatus in which the footrest portion can be retracted into the platform of the wheeled apparatus or extended to various positions for ease of use.

A wheeled platform apparatus in which the wheels are partially inset into an opening or recessed area in the apparatus creating a lower center of gravity for improved stability.

A wheeled platform in which a portion of the top surface forms a cupped area in the front half of the wheeled apparatus to stabilize the first foot in a secure position.

A wheeled platform in which a strap is permanently attached to the apparatus secured between a top layer of cushioning or shock absorbing material and a wheeled apparatus for easy on and off and optimizing the foot position of the user.

A wheeled platform apparatus in which a rear portion is positioned at an angle such that a user can operate using two or more wheels in the base portion of the board or operate using the wheel or wheels in the back portion and the back most wheel of the base portion simultaneously lifting the front most wheel off the skating surface.

A wheeled platform in which two or more center wheels are used for skating but includes lateral wheels on a different plane so that a user can shift weight to the side thus engaging lateral wheels(s) for enhanced maneuverability.

A wheeled platform in which a shock-absorbing ring made of a polymer or other suitable material is positioned over the axle and secured into the wheel support bracket creating a smoother ride and enhancing maneuverability.

The invention claimed is:

1. A foldable wheeled platform apparatus configured to transport a rider across a surface while the rider has at least a portion of a front foot positioned on the wheeled platform apparatus, the foldable wheeled platform apparatus comprising:

- a platform having a first piece and a second piece, the platform having an upper surface, a bottom surface, a front portion, a mid portion, a back portion, a right side, and a left side;
- a first wheel positioned adjacent the bottom surface and the front portion of the platform;
- a second wheel positioned adjacent the bottom surface and the mid portion of the platform and adjacent the first wheel;
- a third wheel positioned adjacent the bottom surface and the back portion of the platform;
- a hinge configured between the two pieces of the platform to provide hinged rotation between the two pieces of the platform;
- a first recess provided on or adjacent the bottom surface and between the first wheel and the second wheel, wherein the first recess extends through the right and left sides of the platform;
- a second recess provided on or adjacent the bottom surface and between the second wheel and the third wheel, wherein the second recess extends through the right and left sides of the platform;

wherein the foldable wheeled platform apparatus is configured to have at least a portion of the front foot of the rider positioned on the upper surface of the platform at the front portion of the platform above the first wheel while at least a portion of a forefoot of the front foot of the rider is positioned off the upper surface of the platform while transporting the rider; and wherein the foldable wheeled platform apparatus is configured to be placed in a folded state using the hinge to position at least a portion of the third wheel in the first recess, and to position the second recess around at least a portion of the second wheel; and wherein one of the first piece and the second piece is shorter than the other of the first piece and second piece such that the first wheel is not in a storage recess when the foldable wheel platform is in the folded state.

2. The foldable wheeled platform apparatus of claim 1, wherein the foldable wheeled platform apparatus is configured to have a portion of a back foot of the rider positioned on the upper surface of the platform at the back portion of the platform while transporting the rider.

3. The foldable wheeled platform apparatus of claim 1, wherein the first wheel, the second wheel, and the third wheel rotate primarily below the bottom surface of the platform.

4. The foldable wheeled platform apparatus of claim 1, wherein the first wheel and the second wheel are positioned substantially in line with one another and at least partially below the bottom surface of the platform.

5. The foldable wheeled platform apparatus of claim 1, wherein the first piece and the second piece of the platform are positioned parallel to one another when the foldable wheeled platform apparatus is positioned in the folded state.

* * * * *